US005502990A

United States Patent [19]

Hirvi

[11] Patent Number: 5,502,990

[45] Date of Patent: Apr. 2, 1996

[54] RECODABLE LEVER TUMBLER LOCK FOR USE IN HIGH SECURITY SAFES

[75] Inventor: Jorma Hirvi, Ärla, Sweden

[73] Assignee: Sargent & Greenleaf, Nicholasville, Ky.

[21] Appl. No.: 337,494

[22] Filed: Nov. 8, 1994

[30] Foreign Application Priority Data

Jan. 14, 1994 [SE] Sweden ..... 9400086

[51] Int. Cl.[6] ..... E05B 25/00

[52] U.S. Cl. ..... 70/383; 70/354

[58] Field of Search ..... 70/383, 384, 385, 70/315, 316, 317, 318, 382, 353, 354, 355, 337, 341, DIG. 75, DIG. 71, DIG. 44, DIG. 28, DIG. 21

[56] References Cited

U.S. PATENT DOCUMENTS

| | | | |
|---|---|---|---|
| 374,784 | 12/1887 | Doremus | 70/383 |
| 666,697 | 1/1901 | Roche . | |
| 690,537 | 1/1902 | Taylor . | |
| 814,335 | 3/1906 | Taylor | 70/385 |
| 1,136,067 | 4/1915 | Watson . | |
| 1,374,310 | 4/1921 | Marvel | 70/385 |
| 1,826,595 | 10/1931 | Benham | 70/385 |
| 3,436,941 | 4/1969 | Potzick | 70/317 |
| 3,884,058 | 5/1975 | Terry et al. | 70/355 |
| 3,983,728 | 10/1976 | Phillips | 70/383 |
| 4,072,032 | 2/1978 | Phillips | 70/339 |
| 4,290,287 | 9/1981 | Peppard | 70/383 |
| 4,462,230 | 7/1984 | Evans | 70/383 |
| 4,907,431 | 3/1990 | Mauer | 70/355 |
| 5,072,604 | 12/1991 | Eisermann | 70/276 |

*Primary Examiner*—Darnell M. Boucher
*Attorney, Agent, or Firm*—Popham, Haik, Schnobrich & Kaufman, Ltd.

[57] ABSTRACT

In a recodable lever tumbler lock such as used with a safety deposit box lock, a coding device (17) and a recoding pin of particular configuration are caused to interact with remaining components of the lock mechanism of more conventional construction. When the lock is activated to its normal retracted position, one end of the coding device functions as a stop abutment and engages a waist portion on the recoding pin whereby another part of the coding device engages a hook means provided on the periphery of a dog (7) included in the lock, and the dog can be rotated only through about 150° with the ordinary key. When the lock is to be recoded so as to work with a different key, the lock is first activated to its locking mode with the door open, and the recoding pin is moved to a second end position by manual manipulation. In this second end position, the end (17*e*) of the coding device is prevented from entering a waist on the pin and therewith enables the dog to be rotated through 180° and the key (5) to be replaced with a new key (6). At the end of this locking movement, the coding device is released from its engagement with the fences and recoding of the lock to the new key takes place and the coding device locks the fences (15) in their newly adopted positions. The recoding pin (21) is returned automatically to its normal position.

8 Claims, 3 Drawing Sheets

RECODABLE LEVER TUMBLER LOCK FOR USE IN HIGH SECURITY SAFES

BACKGROUND OF THE INVENTION

1. Field of the Invention

The present invention relates to a recodable lever tumbler lock of the kind which comprises a plurality of spring-biassed lever tumblers which are pivotal about a respective pivot axle and which are provided at their ends distal from the pivot axle with an aperture or gate for receiving a leg of a fence which is mounted for rectilinear movement transversely to the direction of movement of the lock bolt. Each fence includes teeth which when coding the lock in conjunction with turning the key to bring the bolt to its locking or latching mode engages in a toothed coding device, wherein the legs of respective fences move out of the aperture or gate in the lever tumbler as the bolt moves to its locking position. The lever tumblers are returned to their original positions by respective springs, when turning of the key is completed.

If it is found necessary to recode the lock for some reason, for instance, to change the lever permutation because a key has been lost so that the lock can be operated with another key, the lock is first locked with the aid of a key which fits the current code, with the door of the safe deposit box held open so that the lock housing is accessible from inside the door. Subsequent to activating some type of latching device, the door is locked from the inside with the aid of the key, which normally has a greater turning angle than is permitted in the normal position of the latching device, whereupon the key is removed from the lock and the new key is inserted. The lever tumblers are recoded at the same time as the lock is brought to the locking mode with the aid of the new key, wherein said levers are lifted by the key bit (wards) to code positions different than those that were applicable to the key earlier used. At the same time, each lever tumbler pushes an associated fence transversely to the direction of bolt movement to a new position in which the fences are fixed in position with the aid of the coding devices during the final stage of bringing the lock to its locking mode.

The lock is therewith coded in accordance with the new key, which can be removed from the lock with the lock bolt in its outwardly projected locking position.

2. Related Art

Different types of related recodable or changeable lever tumbler locks are known to the art. For instance, U.S. Pat. No. 4,462,230 (Evans) teaches a lever tumbler lock in which a screw is rotated through a given number of turns by means of an appropriate tool in conjunction with coding the lock, after which the lock code is fixed by turning the screw in the other direction. There is a danger with this solution that the code will not be fixed satisfactorily if the screw is not tightened correctly.

Another drawback with this lock is that it is not compact enough and consequently it is possible to reach the lock mechanism and "feel" the mechanism with a steel wire or the like inserted into the lock housing.

U.S. Pat. No. 1,693,731 (Sioberg) teaches a similar, although slightly differently designed lock construction in which the latching element can be swung with the aid of a tool. In this case, the coding device coacts with a projection on a main lever tumbler. When the coding device is swung to one side, no engagement will take place between the coding device and the projection, therewith enabling the lock to be recoded.

This lock mechanism is also comparatively complicated and bulky, i.e. it suffers generally the same drawbacks as those encountered with the aforedescribed lock construction of Evans.

Further examples of the present standard techniques are found in U.S. Pat. No. 4,290,287 (Peppard) in which a pivotal latching device is used, U.S. Pat. No. 3,884,058 (Terry) in which the lock is not recodable and in which tumblers of alternating shorter and longer lengths are alternately used, DE-C 109,243 (Sommermeier) in which the coding device is comprised of pins which move parallel with the bolt, DE-A 2,800,539 (Kromer) in which the lock construction is not recodable, DE-C 389,133 (Hartlaub) which teaches a lock which comprises a number of lever tumblers that are able to swing in opposite directions and a number of apertured latching pins, and FR-A 2,663,072 (Comforti) which teaches a lock construction comprising mutually adjacent fences, each having a leg which engages a corresponding aperture or gate on a lever tumbler.

None of these known lock constructions can be considered to completely fulfil present-day demands for locks which are simple, reliable, compact and non-forcible.

OBJECTS OF THE INVENTION

The present invention relates more specifically to a recodable or changeable lock. One object of the invention is to provide a recodable lock of a kind which is constructed basically from parts which can be readily manufactured and fitted and which will coact effectively without risk of disturbance.

Another object is to provide a lock of the aforesaid kind which cannot be easily forced and which will function reliably despite its small dimensions.

A further object is to provide a lock of the aforesaid kind which can be easily recoded with the aid of an element, preferably a finger-actuable element, which can be reached easily from outside the lock housing.

Still another object is to provide a lock which has a compact lock casing and which can only be reached with a tool with great difficulty, or not at all.

Still further objects and advantages will become apparent from a consideration of the ensuing description and drawings.

SUMMARY OF THE INVENTION

The advantages afforded by the invention are by virtue of the fact that the coding device is comprised of an element of the given kind which is movable together with the lock bolt as it moves in and out from its extended locking position to and from its retracted release position. However, the bolt also moves through a limited distance in relation to the coding device. In this way, the coding device is able to coact with a simple recoding element which is adjusted in conjunction with changing the combination or permutation of the lock, i.e. recoding, so that the coding device will be prevented from accompanying the bolt along the full extent of its movement path from a fully locked position. Thus, in the final stage of the bolt release movement in conjunction with recoding the lock, relative movement will take place between the bolt and the coding device, more specifically the tooth of the coding device will disengage from the teeth of the fence in the final stage of bolt movement. The lock is thereby ready for immediate recoding, which can be effected immediately when a new key is inserted in the keyhole of the lock and the dog has been rotated by the key, thereby lifting the lever tumblers to their new positions determined by the new key.

Thus, it is not necessary to activate the lever tumblers by means of the latching device, as is the case in a number of the aforementioned known lock constructions.

The configuration or construction of the coding device can be adapted readily to the dimensions of the lock case concerned while ensuring that it is guided satisfactorily, for instance by an appropriate flat surface in the lock casing or by some other suitable means, for instance a pin, in said casing, thereby providing a lock of faultless function both when locking and releasing the lock and also when recoding the lock.

The recoding element can also be made simple and easy to reach from outside the lock casing. In one preferred embodiment, the recoding element will be in the form of a pin which is movable at right angles to the direction of movement of the bolt and has an end which can be reached from outside the back of the lock casing. It will be seen that a pin of this kind can be easily finger-actuated without needing to open the lock casing when recoding the lock.

The function of the recoding pin as a coding device stop abutment is effected in a purposeful manner when the pin has the construction where the pin has a stem which includes alternate larger diameter portions and smaller diameter waist portions therebetween having different axial lengths. By providing the pin with two waists of different axial lengths and also with portions of larger diameter, the end of the coding device can be readily given a configuration which allows it to enter the waist of greater axial length in the case of normal lock release movements, which means that in this case the pin will not function as a coding device stop abutment.

When the lock is to be recoded, the pin is moved to a position in which the end of the coding device will engage one or two pin portions of greater diameter and will be unable to engage the waist portion located therebetween. In this case, the pin functions as a coding device stop abutment which results in the aforesaid relative movement between the lock bolt and the coding device, thereby ensuring that the key can be rotated through 180° from the initial position of the dog. The fences are released in the aforesaid manner.

It is also preferred that the lock bolt is provided on that side thereof which lies proximal to the recoding pin with a projection of such thickness and so positioned that when the lock moves to its lock release position the projection is able to enter either of the smaller diameter waist portions on the recoding pin. When the recoding pin is in a first, normal position, the projection engages with the waist portion of greater axial length, and when the recoding pin is moved inwardly relative to the lock casing the projection engages with the outermost waist portion of smaller axial length. Engagement of the lock bolt projection with the outermost waist portion of the recoding pin ensures that the recoding pin will remain in the adopted recoding position until the final stage of the locking movement of the bolt, whereupon the projection will leave the outermost waist portion in the recoding pin and the pin will be biased automatically back to its starting position by the spring coacting with said pin.

Thus, in the case of this preferred embodiment, no separate manual means are required for returning the recoding pin to its starting position.

Further advantageous developments of the invention will become clear after a review of the following detailed description of the preferred embodiments.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

Finally.

DESCRIPTION OF PREFERRED EMBODIMENTS

Figures 1, 2:
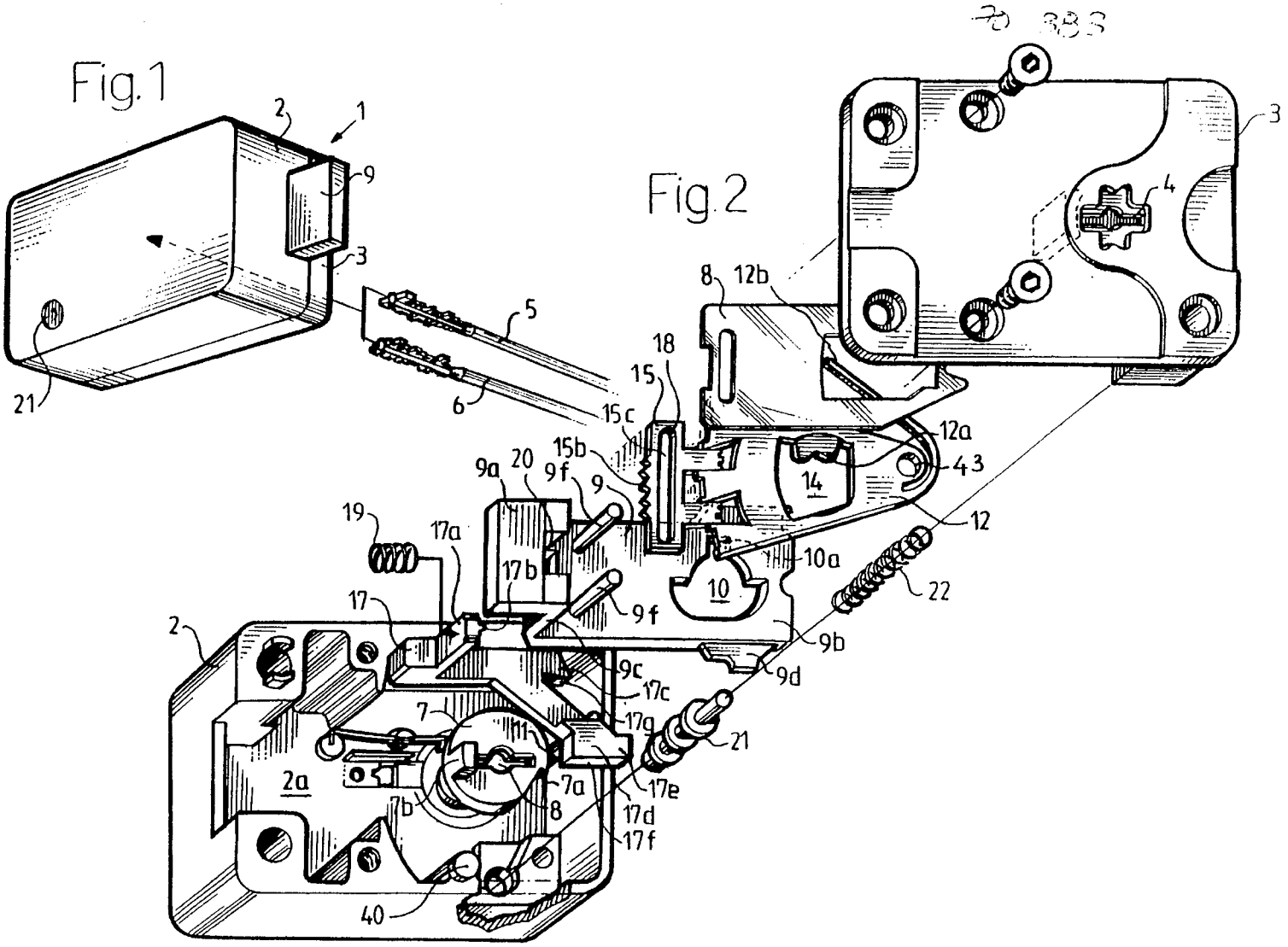
FIG. 1 is a perspective view of an inventive recodable lever tumbler lock, and also shows two keys of which one can only be used after the lock has been recoded.
FIG. 2 is an exploded view, in perspective, of the significant parts of the illustrated lock construction.

FIG. 1 illustrates a recodable lever tumbler lock for a high security safe, such as a safe deposit box, comprising a lock casing or lock housing 1 which includes a bottom part 2, a removable cover 3, and a lock bolt 9*a* which projects out from the lock casing in the locked state of the lock. The lock has a key 5 and a further key 6 which can be used when recoding the lock as described in detail below. Recoding of the lock is effected with the aid of a finger-actuable recoding pin 21 which can be reached from outside the bottom part 2.

The various components of the lock mechanism are shown in the exploded view of FIG. 2.

FIG. 2 illustrates primarily the general construction of the bottom part 2 of the lock casing 1 and the cover 3 screwed to the bottom part 2, and the key slot 4.

Mounted in the region of the bottom 2*a* of the base part 2 is a rotatable dog 7 which is roughly circular in shape and includes a key slot 8. The dog 7 includes peripherally a hook means 7*a*, whose function will be described below, and a camming or dogging element 7*b* which projects at right angles from the plane of the dog and which functions to translate rotary movement of the dog to rectilinear movement of the lock bolt 9.

The lock bolt 9 has an essentially flat main portion 9*b* and a transition portion 9*c* which projects up from the main portion 9*b* at right angles thereto and from which the bolt front portion 9*a* extends parallel with the main bolt portion 9*b*. The main bolt portion 9*b* is provided in the region of the dog 7 with an aperture 10 which includes an aperture part 10*a* intended for coaction with the camming element 7*b* of the dog 7 in a manner to translate rotary movement of the dog to rectilinear movement of the lock bolt 9.

Located in the junction between the transition bolt part 9*c* and the bolt part 9*a* is an aperture 20 which receives an upwardly projecting part 17*a* of a coding device 17, as described in more detail below.

Stacked on the bolt are a number of lever tumblers 12, each of which has a central aperture 14 which accommodates a device 12*a* which is intended to be actuated by a key bit (wards) so as to "lift" the lever tumbler as the bolt is projected and retracted to its locking and release position. Each of the lever tumblers is provided at its end distal from the lock bolt with a hole 43 for receiving a pivot axle (not shown in FIG. 2) about which the lever pivots. The pivot lever is provided at its opposite end with two apertures or gates 13 which are intended to receive a corresponding number of legs 15*a* of a fence 15. The number of fences 15 will thus correspond to the number of lever tumblers and when changing the lock coding, they are guided for movement transversely to the direction of bolt movement in a manner described herebelow. To this end, the main bolt part 9*b* includes two guide elements 9*f* which project up at right angles to its plane and which enter slots 18 extending rectilinearly in the fences 15. Each of the fences 15 has provided on its end proximal to the bolt part 9*a* teeth 15*b* which are intended to coact with the tooth 17*b* on the part 17*a* of the coding device 17 that projects up through the aperture 20 in the bolt.

Figure 3:
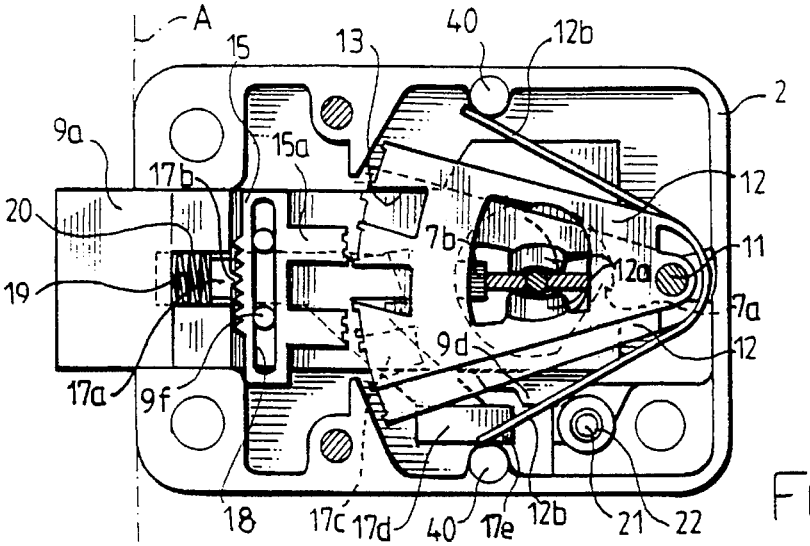
FIG. 3 shows the lock of FIGS. 1 and 2 from above, with the cover removed so as to show the position of the various lock components when the lock bolt is fully projected to its locking position.

Each of the lever tumblers 12 has an integrated spring element 12*b* for abutment with an element 40 in the lock casing (c.f. FIG. 3, for instance).

Inserted between mutually adjacent lever tumblers 12 is a thin shim made of plastic or like material to facilitate movement of the tumblers in relation to one another.

The coding device 17 mentioned briefly above will now be described in more detail. As before mentioned, the coding device 17 includes a part 17*a* which extends at right angles to the coding device part 17*c* located in the region of the base bottom 2*a*. The coding device part 17*a* enters the aperture 20 in the lock bolt, where it is held in position by the spring 19 mounted in said aperture. It will be evident that the coding device 17 will accompany the lock bolt 9 as it is extended and retracted. It will also be evident that the coding device 17 is able to move to a limited extent relative to the bolt 9, more specifically against the action of the spring 19. This possibility of limited relative movement is utilized when recoding the lock, which is effected in a manner described in more detail below.

The main part 17*c* of the coding device also includes a hook means 17*g* which is adapted for coaction with the hook means 7*a* provided peripherally on the dog 7, and more specifically so that subsequent to turning the hook means 7*a* on the dog 7 through an angle of about 150° from a bolt-projected locking position, wherewith the bolt 9 and the coding device 17 thus move to the right in FIG. 2, said hook means 7*a* will come into engagement with the hook means 17*g* on the coding device 17, therewith rendering further rotation of the dog 7 impossible. This makes it impossible to remove the key from the key slot 4 with the lock bolt in its retracted lock-release position.

The main part 17*c* of the coding device merges with an end-part 17*d* having a flat side surface 17*f* which as the coding device moves forms a coding device guide means in abutment with an element 40 or a flat surface on the lock casing.

Figure 6:
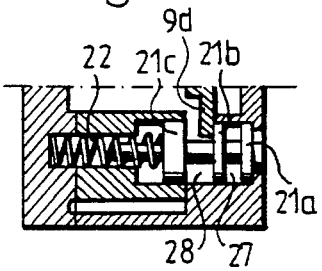
FIG. 6 is a sectional view taken on the line VI—VI in FIG. 5 and illustrates coaction of the recoding pin with the projection on the lock bolt in the retracted position of said bolt.

The end-part 17*d* of the coding device is terminated with a stop shoulder 17*e* of precise, predetermined thickness which is intended to coact with a recoding pin 21 which can be moved axially in the lock casing by finger action from a "normal position" to a recoding position, against the action of a spring 22. To this end, the recoding pin 21 includes parts of larger diameter 21*a*, 21*b*, 21*c* (see FIG. 6) which define therebetween waists 27, 28 of mutually different axial heights or lengths.

The stop shoulder 17*e* on the end-part 17*d* of the coding device 17 is able to enter the waist 28 of greater axial height when the recoding pin 21 is located in its normal position, but is restricted in its movement by the part 21*a* and/or the part 21*b* when the pin 21 is located in its recoding position. In this position, a projection 9*d* on one side edge of the main bolt part 9*b* enters the narrower waist 27 of the recoding pin 21 and therewith prevents the pin from returning to its normal position under the influence of the spring 22.

In the final stage of forward movement of the bolt when projecting the bolt to its locking position, the projection 9*d* leaves the waist 27 and the pin will be returned automatically to its normal position, under the action of the spring 22.

FIG. 3 illustrates the lock mechanism in its locking mode. In this case, the legs 15*a* of the fences 15 have left the apertures or gates 13 in the lever tumblers 12 and the legs therewith prevent any attempt to move the bolt part 9*a* inwardly to a lock release position with the aid of a tool. The fences 15 are locked by engagement of the tooth 17*b* on the coding device part 17*a* between two mutually adjacent teeth 15*b* on respective fences.

Figure 4:
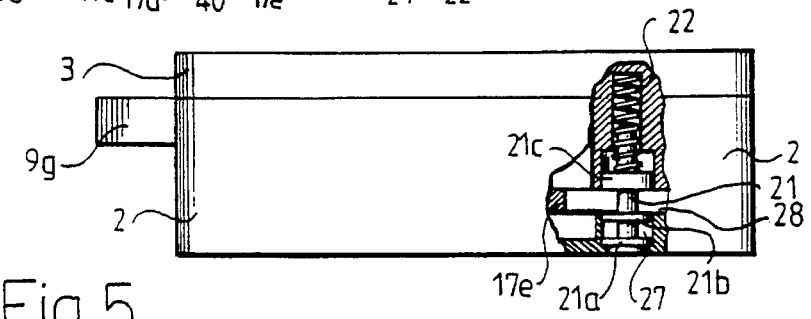
FIG. 4 illustrates the lock casing from one side with the lock bolt projected, and part of the lock case is cut away to illustrate coaction of the recoding pin with the coding device and the position taken by the projection on the lock bolt in the extended locking position of the bolt.

As will be seen from FIG. 4, no relevant part engages with any of the waists 27, 28 of the recoding pin 21 when the lock bolt is projected to its locking position.

Figure 5:
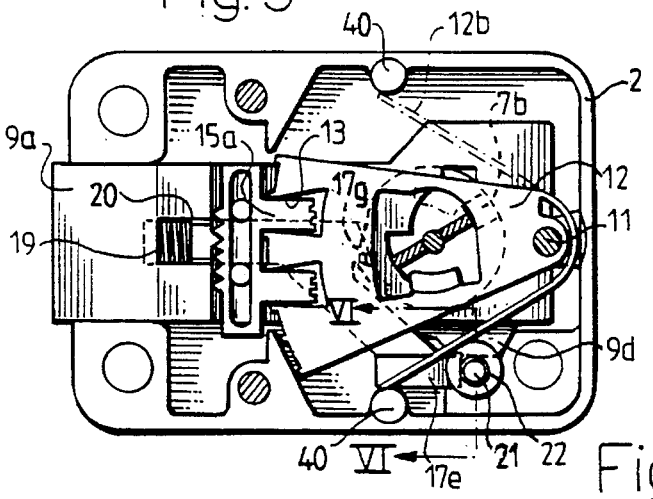
FIG. 5 is a view corresponding to the view of FIG. 3 but with the lock bolt shown in its retracted lock-release position.

FIG. 5 illustrates the lock mechanism in its open mode, wherein the legs 15*a* of the fences 15 engage the apertures 13 in respective lever tumblers, this engagement being achieved as the tumblers are lifted by respective key bits.

FIG. 5 also shows that the key 5 has turned the dog 7 through an angle of about 150°, so as to bring the peripheral hook means 7*a* on the dog into engagement with the engagement part 17*g* of the coding device. The dog is therewith prevented from further rotation, meaning that the key cannot be removed in the open or release position of the lock mechanism.

Figure 7:
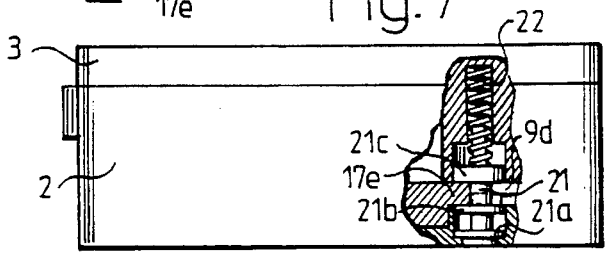
FIG. 7 is a view corresponding to the view of FIG. 4 which shows the lock bolt in a retracted position and in which part of the lock casing has been cut away to illustrate the position of the end of the coding device, which in this case engages the waist on the recoding pin that has the greater axial length.

It will be seen from FIG. 7 that the stop shoulder 17*e* on the end-part 17*d* of the coding device has entered the larger waist 28 on the recoding pin 21. The projection 9*d* on the bolt 9 engages the same waist 28 on the recoding pin 21 at the same time (see FIG. 6).

Figure 8:
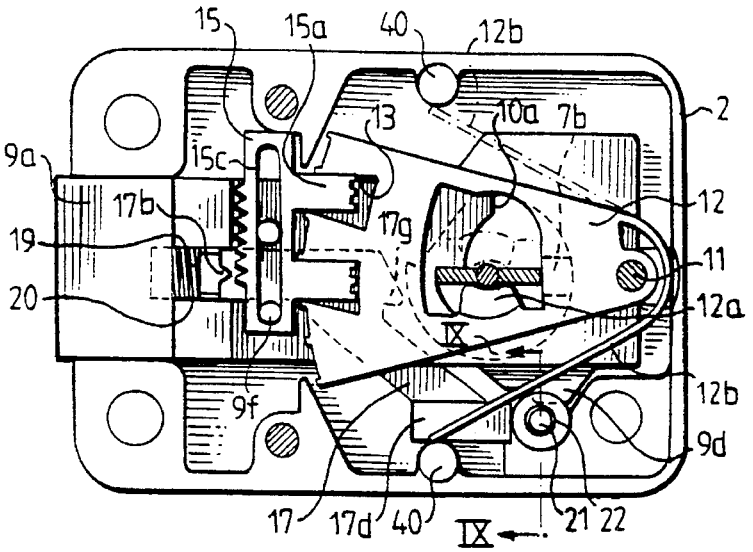
FIG. 8 is a view corresponding to the views of FIGS. 3 and 5 and shows the cover removed from the lock and the recoding pin depressed and the key turned through 180° from its starting position.
Figure 9:
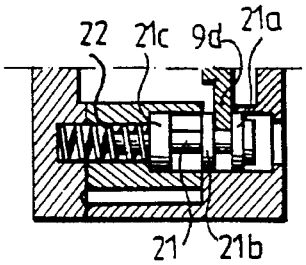
FIG. 9 is a section view corresponding to FIG. 6 and illustrates coaction of the recoding pin with the projection on the lock bolt in the recoding position of the pin.
Figure 10:
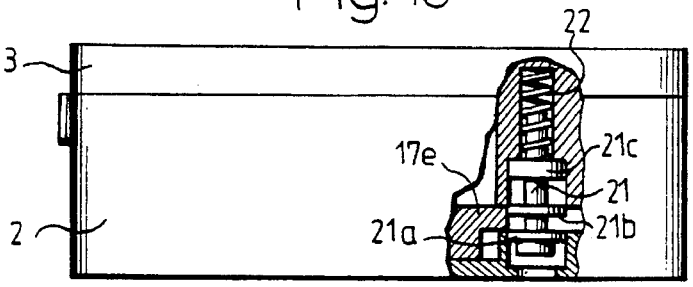
FIG. 10 is a view corresponding to the views of FIGS. 4 and 7 with part of the lock casing removed to illustrate the function of the recoding pin as a coding device stop abutment in the recoding position of the pin.

FIGS. 8–10 illustrate the circumstance when a new key is to be inserted into the lock and the lock mechanism recoded in accordance with this new key.

In this regard, the lock mechanism is brought to its locking mode with the aid of the key earlier used, while keeping the door open so as to have access to the lock casing and then particularly to the recoding pin 21.

The recoding pin 21 is then pressed-in to its inner limit position while releasing the lock. In the final stage of this movement, the stop shoulder 17*e* of the coding device will reach the recoding pin 21 but will no longer be able to enter the waist 28 of greater height, since this waist has been displaced upwards. The stop shoulder 17*e* therewith strikes against the pin parts 21*a*, 21*b*, which means that the engagement element 17*g* of the coding device will not come into contact with the peripheral hook means 7*a* on the dog 7. In turn, this means that their lock release movement can be continued so as to rotate the dog 7 through 180°. Since the coding device is prevented from accompanying rectilinear movement of the lock bolt over this last movement path, the bolt 9 and the coding device 17 will, instead, move relative to one another and therewith distance the fences 15, which move together with the bolt, away from the part 17*a* of the coding device provided with the tooth 17*b*, this being possible because of the extension of the aperture 20 in the bolt accommodating the coding device part 17*a* and the spring 19.

Engagement between the tooth 17*b* and the fences 15 ceases, thereby enabling the lock code to be changed.

Consequently, the key 5 is removed from the key slot 4 in the lock casing cover 3, which is made possible by rotating of the dog through 180°.

A new key 6 is then inserted and turned so as to bring the lock mechanism to its locking mode. At the same time, the various lever tumblers 12 are lifted by respective key bits (wards) and take new positions determined by the configuration of respective key bits (wards). At tie same time, the fences 15 are moved transversely to the direction of bolt movement, since the legs 15*a* of the fences are still located in the gates or apertures 13 of respective lever tumblers 12.

Because the projection 9*d* will be located in the narrower waist 27 during the major part of the locking movement, the recoding pin 21 will remain in the adopted recoding position.

The projection 9*d* leaves the waist 27 in the final stage of the locking movement, whereupon the pin 21 is returned automatically to its normal position by the spring 22. At the end of the locking movement, recoding of the lock is complete and a situation corresponding to that illustrated in FIG. 3 occurs, although with the lever tumblers 12 and the fences 15 in positions different to those earlier occupied. The tooth 17*b* on the coding device engages between two teeth 15*b* on the fences and locks the new code.

The new key can now be removed from the lock and is now the correct lock key, since the lock can no longer be opened with the key earlier used.

As will be evident, in the case of the illustrated embodiment each fence 15 has two legs and each lever tumbler 12 has two corresponding apertures or gates 13. This will ensure that the latching contact surfaces between the fence legs and the end edges of the apertures 13, i.e. those locations at which force is taken up between fence and tumbler, lie as close as possible to the center line. In the case of locks which comprise only one leg and one aperture, the point of engagement can lie far from the center line. However, the invention can also be applied with locks of this type.

All lever tumblers 12 may be of mutually the same construction and their leaf-spring elements 12*b* may form an integral part of the actual lever tumbler. The lever tumblers may be positioned as desired, for instance so that each alternate spring element will face to the left and each other element will face to the right. Alternatively, all spring elements may face in one and the same direction or, in the case of a lock provided with nine lever tumblers, six or seven spring elements may face in one direction and two or three may face in the other direction.

This will make forcing of the lock difficult, since anyone attempting to force the lock will have no prior knowledge of how the lever tumblers are positioned in the lock concerned.

I claim:

1. A recodable lever tumbler comprising:

a lock casing having a substantially flat, bottom inside surface and a boss projecting upwardly from said bottom inside surface;

a dog rotatably mounted on and extending upwardly from said lock casing bottom inside surface and said dog having a key recess, a radially projecting hook portion and an axially extending camming element;

a lock bolt having a substantially flat main portion, a transition portion projecting upwardly from said main portion, and a front portion extending from said transition portion and being parallel to said main portion, with said main portion having a first aperture therethrough for receiving said dog and said first aperture having a radially outwardly extending notch portion for coacting with said camming element, said lock bolt being mounted in said lock casing for rectilinear motion extending from said lock casing to a locked position and retracting into said lock casing to an unlocked position wherein rotation of said dog is converted to rectilinear motion of said lock bolt by said camming element, and said lock bolt transition portion has a second aperture therethrough;

a plurality of lever tumblers, each being pivotally mounted at one end to said lock casing and each of said tumblers having a central aperture for accommodating a key bit actuated means for pivoting said tumbler as said lock bolt is extended and retracted, and a plurality of gates extending inwardly from an end of said tumbler opposite said one end;

a plurality of fences slideably mounted on said lock bolt main portion for movement in a direction transverse to said lock bolt rectilinear motion and each having a plurality of legs extending in a first direction and teeth extending in a second direction opposite said first direction;

a coding device slideably mounted on said lock casing bottom inside surface and having an upwardly projecting key portion, a radially extending hook portion, and an axially extending shoulder portion of predetermined thickness wherein said upwardly projecting key portion extends through said lock bolt transition portion second aperture, said radially extending hook portion is positioned so as to interfere with said dog hook portion during a part of the rotation of said dog, and said upwardly projecting key portion is biased by a spring located between said coding device key portion and said lock bolt transition portion into engagement with said fence teeth thereby preventing movement of said fences in a direction transverse to said lock bolt rectilinear motion while said key portion is engaged with said fence teeth; and a recoding pin having a central axis and being mounted in said lock casing for axial movement between a first, deactivated position wherein said recoding pin does not interfere with said coding device shoulder portion, and a second, activated position wherein said recoding pin interferes with said coding device shoulder portion, thereby overcoming said spring bias of said coding device key portion and causing said coding device to move relative to said lock bolt during retraction of said lock bolt.

2. The recodable lever tumbler lock of claim 1 wherein said recoding pin axial movement is in a direction perpendicular to the direction of said lock bolt rectilinear motion, and wherein one axial end of said recoding pin is accessible for manual activation from outside of said lock casing.

3. The recodable lever tumbler lock of claim 2 wherein said recoding pin has a plurality of axially spaced larger diameter blocking portions and a plurality of axially spaced smaller diameter waist portions separating said larger diameter blocking portions and having different axial lengths.

4. The recodable lever tumbler lock of claim 3 wherein said coding device shoulder portion is received in a first waist portion of said recoding pin located in between two blocking portions of said recoding pin when said recoding pin is in said first, deactivated position; and said coding device shoulder portion is blocked from entering a second waist portion having a smaller axial length than said first waist portion by blocking portions of said recoding pin adjacent said second waist portion when said recoding pin is in said second, activated position.

5. The recodable lever tumbler lock of claim 4 wherein said lock bolt main portion has a laterally extending side projection that is received in said recoding pin first waist portion when said lock bolt is in said retracted, unlocked position and said recoding pin is in said first, deactivated position; and said side projection is received in said recoding pin second waist portion when said lock bolt is in said retracted, unlocked position and said recoding pin is in said second, activated position.

6. The recodable lever tumbler lock of claim 5 wherein said recoding pin is spring biased to said first, deactivated position and said lock bolt side projection retains said recoding pin in said second, activated position against said spring bias when said recoding pin is moved to said second, activated position and subsequently said locking bolt is moved to said retracted, unlocked position.

7. The recodable lever tumbler lock of claim 1 wherein said coding device shoulder portion is guided along said lock casing boss during said rectilinear motion of said lock bolt.

8. The recodable lever tumbler lock of claim 1 wherein said fence legs are received in said lever tumbler gates when said lock bolt is moved from said extended, locked position to said retracted, unlocked position.

* * * * *